US006077415A

United States Patent [19]

Duruz et al.

[11] Patent Number: 6,077,415

[45] Date of Patent: Jun. 20, 2000

[54] MULTI-LAYER NON-CARBON METAL-BASED ANODES FOR ALUMINUM PRODUCTION CELLS AND METHOD

[75] Inventors: Jean-Jacques Duruz, Geneva, Switzerland; Vittorio de Nora, Nassau, Bahamas

[73] Assignee: Moltech Invent S.A., Luxembourg, Luxembourg

[21] Appl. No.: 09/126,206

[22] Filed: Jul. 30, 1998

[51] Int. Cl.[7] ..... C25C 3/08; C25C 3/12; C25B 11/00

[52] U.S. Cl. ..... 205/384; 204/243.1; 204/244; 204/245; 204/290 R

[58] Field of Search ..... 204/290 R, 243.1, 204/244, 245; 205/380–381, 384

[56] References Cited

U.S. PATENT DOCUMENTS

| | | | |
|---|---|---|---|
| 5,254,232 | 10/1993 | Sadoway | 704/290 R |
| 5,486,278 | 1/1996 | Manganiello et al. | 204/290 R X |
| 5,851,677 | 12/1998 | Laurent et al. | 204/290 R X |
| 5,855,751 | 1/1999 | Rangarajan et al. | 204/290 R |
| 5,873,988 | 2/1999 | Schulze et al. | 204/290 R X |
| 5,904,828 | 5/1999 | Sekhar et al. | 204/290 R X |

*Primary Examiner*—Donald R. Valentine
*Attorney, Agent, or Firm*—Jayadeep R. Deshmukh

[57] ABSTRACT

A composite, high-temperature resistant, non-carbon metal-based anode of a cell for the electrowinning of aluminium comprises a metal-based core structure of low electrical resistance, for connecting the anode to a positive current supply, coated with a series of superimposed, adherent, electrically conductive layers. These layers consist of at least one layer on the core structure constituting a barrier substantially impervious to monoatomic oxygen and molecular oxygen; one or more intermediate, protective layers on the oxygen barrier layer which remain inactive in the reactions for the evolution of oxygen gas; and an electrochemically active layer for the oxidation reaction of oxygen ions present at the anode/electrolyte interface into nascent monoatomic oxygen, as well as for subsequent reaction for the formation of gaseous biatomic oxygen. The active layer on the outermost intermediate layer is slowly consumable during electrolysis and protects the intermediate protective layer by inhibiting its dissolution into the electrolyte.

43 Claims, No Drawings

MULTI-LAYER NON-CARBON METAL-BASED ANODES FOR ALUMINUM PRODUCTION CELLS AND METHOD

FIELD OF THE INVENTION

This invention relates to multi-layer non-carbon, metal-based anodes, for use in cells for the electrowinning of aluminium by the electrolysis of alumina dissolved in a molten fluoride-containing electrolyte, and to methods for their fabrication and reconditioning, as well as to electrowinning cells containing such anodes and their use to produce aluminium.

BACKGROUND ART

The technology for the production of aluminium by the electrolysis of alumina, dissolved in molten cryolite, at temperatures around 950° C. is more than one hundred years old.

This process, conceived almost simultaneously by Hall and Heroult, has not evolved as many other electrochemical processes.

The anodes are still made of carbonaceous material and must be replaced every few weeks. The operating temperature is still not less than 950° C. in order to have a sufficiently high solubility and rate of dissolution of alumina and high electrical conductivity of the bath.

The carbon anodes have a very short life because during electrolysis the oxygen which should evolve on the anode surface combines with the carbon to form polluting $CO_2$ and small amounts of CO and fluorine-containing dangerous gases. The actual consumption of the anode is as much as 450 Kg/Ton of aluminium produced which is more than ⅓ higher than the theoretical amount of 333 Kg/Ton.

The frequent substitution of the anodes in the cells is still a clumsy and unpleasant operation. This cannot be avoided or greatly improved due to the size and weight of the anode and the high temperature of operation.

Several improvements were made in order to increase the lifetime of the anodes of aluminium electrowinning cells, usually by improving their resistance to chemical attacks by the cell environment and air to those parts of the anodes which remain outside the bath. However, most attempts to increase the chemical resistance of anodes were coupled with a degradation of their electrical conductivity.

U.S. Pat. No. 4,614,569 (Duruz et al.) describes anodes for aluminium electrowinning coated with a protective coating of cerium oxyfluoride, formed in-situ in the cell or pre-applied, this coating being maintained by the addition of cerium to the molten cryolite electrolyte. This made it possible to have a protection of the surface only from the electrolyte attack and to a certain extent from the gaseous oxygen but not from the nascent monoatomic oxygen.

EP Patent application 0 306 100 (Nyguen/Lazouni/Doan) describes anodes composed of a chromium, nickel, cobalt and/or iron based substrate covered with an oxygen barrier layer and a ceramic coating of nickel, copper and/or manganese oxide which may be further covered with an in-situ formed protective cerium oxyfluoride layer.

Likewise, U.S. Pat. Nos. 5,069,771, 4,960,494 and 4,956,068 (all Nyguen/Lazouni/Doan) disclose aluminium production anodes with an oxidised copper-nickel surface on an alloy substrate with a protective barrier layer. However, full protection of the alloy substrate was difficult to achieve.

A significant improvement described in U.S. Pat. No. 5,510,008, and in International Application W096/12833 (Sekhar/Liu/Duruz) involved micropyretically producing a body from nickel, aluminium, iron and copper and oxidising the surface before use or in-situ. By said micropyretic methods materials have been obtained whose surfaces, when oxidised, are active for the anodic reaction and whose metallic interior has low electrical resistivity to carry a current from high electrical resistant surface to the busbars. However it would be useful, if it were possible, to simplify the manufacturing process of these materials and increase their life to make their use economic.

Metal or metal-based anodes are highly desirable in aluminium electrowinning cells instead of carbon-based anodes. As described hereabove, many attempts were made to use metallic anodes for aluminium production, however they were never adopted by the aluminium industry because of their poor performance.

OBJECTS OF THE INVENTION

An object of the invention is to provide a multi-layer functionally graded coating for metal-based anodes for aluminium electrowinning cells which is substantially impervious to monoatomic oxygen and is electrochemically active for the oxidation reaction of oxygen ions present at the anode/electrolyte interface into monoatomic oxygen, as well as for subsequent reaction for the formation of biatomic molecular oxygen evolving as gas.

Another object of the invention is to provide a coating for metal-based anodes for aluminium electrowinning cells which has a high electrochemical activity, a long life and which can easily be applied onto a metal-based anode substrate.

A further object of the invention is to reduce substantially the consumption of the active anode surface of metal-based anodes for aluminium electrowinning cells which is attacked by the nascent oxygen produced by enhancing the reaction of nascent oxygen to gaseous oxygen which is much less active in oxidising metal anodes of aluminium electrowinning cells.

A major object of the invention is to provide an anode for aluminium electrowinning cells which has no carbon so as to eliminate carbon-generated pollution and eliminate the high carbon anode cost.

SUMMARY OF THE INVENTION

The invention relates to a composite, high-temperature resistant, non-carbon, metal-based anode of a cell for the electrowinning of aluminium by the electrolysis of alumina dissolved in a molten fluoride-containing electrolyte. The anode comprises a metal-based core structure of low electrical resistance, for connecting the anode to a positive current supply, coated with a series of superimposed, adherent, electrically conductive layers. The conductive layers consist of:

a) at least one layer on the metal-based core structure constituting during electrolysis a barrier substantially impervious to monoatomic oxygen and molecular oxygen;

b) one or more intermediate protective layers on the outermost oxygen barrier layer to protect the oxygen barrier by inhibiting its dissolution, which intermediate layer(s) during electrolysis remain inactive in the reactions for the evolution of oxygen gas; and c) an electrochemically active layer on the outermost intermediate layer, for the oxidation reaction of oxygen ions present at the anode/electrolyte interface into nascent monoatomic oxygen, as well as for subsequent reaction for the formation of gaseous biatomic molecular oxygen evolving as gas;

said active layer being slowly consumable during electrolysis and protecting said intermediate protective layer(s) by inhibiting its/their dissolution into the electrolyte.

In this context, metal-based anode means that the anode contains at least one metal in the anode core structure and/or in the protective layers as such or as alloys, intermetallics and/or cermets.

The core structure may comprise at least one metal selected from nickel, copper, cobalt, chromium, molybdenum, tantalum, niobium or iron. For instance, the core structure may be made of an alloy consisting of 10 to 30 weight % of chromium, 55 to 90% of at least one of nickel, cobalt or iron, and 0 to 15% of aluminium, titanium, zirconium, yttrium, hafnium or niobium. Alternatively, the core may be nickel plated copper.

Possibly, the core structure may comprise an alloy or intermetallic compound containing at least two metals selected from nickel, cobalt, iron and aluminium.

Alternatively, the core structure can comprise a cermet containing copper and/or nickel as a metal. The core structure may, in particular, comprise a cermet containing at least one stable oxide selected from nickel cuprate, nickel ferrite, nickel oxide or copper oxide.

Usually, the oxygen barrier layer comprises chromium oxide and/or black non-stoichiometric nickel oxide. Advantageously, the oxygen barrier layer may be formed on the core structure by surface oxidation. However, it is also possible to form an oxygen barrier by slurry application techniques or plasma spraying. The oxygen barrier may optionally be formed by applying a precursor which is then converted into a functional barrier by heat treatment, such as applying a layer of chromium or nickel metal on the core which can then be oxidised.

One of the intermediate layers normally contains copper, or copper with at least one of nickel and cobalt, and/or oxide(s) thereof. An intermediate layer may also comprise iron cuprate, nickel ferrite and/or cobalt ferrite.

Typically, one of the intermediate layers comprises an oxidised alloy containing 20 to 60 weight % of copper with one or more further metals forming a solid solution with copper, such metals being generally nickel and/or cobalt.

Usually, the electrochemically active layer comprises at least one oxide which wears away during electrolysis. Optionally but not necessarily the electrochemically active layer comprises (an) oxide(s) throughout its thickness.

An oxide may be present in the electrochemically active layer as such, or in a multi-compound mixed oxide and/or in a solid solution of oxides. The oxide may be in the form of a simple, double and/or multiple oxide, and/or in the form of a stoichiometric or non-stoichiometric oxide.

The electrochemically active layer may for instance comprise a metal, alloy, intermetallic compound or cermet which during normal operation in the cell is slowly consumable by oxidation of its surface and dissolution into the electrolyte of the formed surface oxide. In this case with the rate of oxidation may be substantially equal to the rate of dissolution.

Advantageously, the electrochemically active layer containing metals is pre-oxidised prior to electrolysis. The metals of the electrochemically active layer may be iron with at least one metal selected from nickel, copper, cobalt, aluminium and zinc.

Optionally, the electrochemically active layer may further comprise at least one additive selected from beryllium, magnesium, yttrium, titanium, zirconium, vanadium, niobium, tantalum, chromium, molybdenum, tungsten, manganese, rhodium, silver, hafnium, lithium, cerium and other Lanthanides.

Advantageously, the electrochemically active layer may also comprise at least one electrocatalyst for the anode reaction selected from iridium, palladium, platinum, rhodium, ruthenium, silicon, tin, mischmetal and metals of the Lanthanide series, and mixture, oxides and compounds thereof, for example as disclosed in concurrently field application Ser. No. 09/126,114.

The electrochemically active layer may be a surface oxidised iron-nickel layer, the surface containing iron oxide and/or nickel oxide.

Alternatively, the electrochemically active layer comprises spinels and/or perovskites. In particular, the electrochemically active layer may comprise ferrites, such as ferrites selected from the group consisting of cobalt, copper, manganese, magnesium, nickel and zinc ferrite, and mixtures thereof, in particular nickel ferrite partially substituted with $Fe^{2+}$. Additionally, the ferrite may be doped with at least one oxide selected from chromium, titanium, tin and zirconium oxide.

The electrochemically active layer can also comprise ceramic oxides containing combinations of divalent nickel, cobalt, magnesium, manganese, copper and zinc with divalent/trivalent nickel, cobalt, manganese and/or iron. The electrochemically active layer may for instance have doped, non-stoichiometric and/or partially substituted spinels, the doped spinels comprising dopants selected from $Ti^{4+}$, $Zr^{4+}$, $Sn^{4+}$, $Fe^{4+}$, $Hf^{4+}$, $Mn^{4+}$, $Fe^{3+}$, $Ni^{3+}$, $Co^{3+}$, $Mn^{3+}$, $Al^{3+}$, $Cr^{3+}$, $Fe^{2+}$, $Ni^{2+}$, $Co^{2+}$, $Mg^{2+}$, $Mn^{2+}$, $Cu^{2+}$, $Zn^{2+}$ and $Li^{+}$.

Advantageously, the electrochemically active layer is initially sufficiently thick to constitute an impermeable barrier to gaseous oxygen penetration, and even to nascent, mono-atomic oxygen.

Any of these layers may be slurry applied, for instance by applying a precursor slurry. The layers may also be applied in the form a precursor powder followed by heat-treating.

Several techniques may be used to apply the layers, such as dipping, spraying, painting, brushing, plasma spraying, electrochemical deposition, physical vapour deposition, chemical vapour deposition or calendar rolling.

The invention also relates to a method of manufacturing an anode as described above. The method comprises the steps of formations of the oxygen barrier layer(s), of the intermediate layer(s) and of the electrochemically active layer. It is possible to form the oxygen barrier by substrate oxidation after the intermediate barrier has been applied onto the substrate.

The method for manufacturing such an anode may also be used for reconditioning an anode whose electrochemically active layer is worn or damaged. The method comprises clearing at least worn and/or damaged parts of the active surface from the core structure or from the outermost intermediate layer to which it adheres and then reconstituting at least the electrochemically active layer.

Another aspect of the invention is a cell for the production of aluminium by the electrolysis of alumina dissolved in a molten fluoride-containing electrolyte comprising at least one composite anode as described above.

Advantageously, the cell may comprise at least one aluminium-wettable cathode which can be a drained cathode on which aluminium is produced and from which it continuously drains.

Usually, the cell is in a monopolar, multimonopolar or in a bipolar configuration. Bipolar cells may comprise the anodes as described above as the anodic side of at least one bipolar electrode and/or as a terminal anode.

In such a bipolar cell an electric current is passed from the surface of the terminal cathode to the surface of the terminal anode as ionic current in the electrolyte and as electronic current through the bipolar electrodes, thereby electrolysing the alumina dissolved in the electrolyte to produce aluminium on each cathode surface and oxygen on each anode surface.

Preferably, the cell comprises means to improve the circulation of the electrolyte between the anodes and facing cathodes and/or means to facilitate dissolution of alumina in the electrolyte. Such means can for instance be provided by the geometry of the cell as described in co-pending application PCT/IB98/00161 (de Nora/Duruz) or by periodically moving the anodes as described in co-pending application PCT/IB98/00162 (Duruz/Bellò).

The cell may be operated with the electrolyte at conventional temperatures, such as 950 to 970° C., or at reduced temperatures as low as 700° C.

Yet another aspect of the invention is a method of producing aluminium in such an aluminium electrowinning cell, wherein alumina is dissolved in the molten fluoride-containing electrolyte and then electrolysed to produce aluminium.

Advantageously, during electrolysis the active layer of the anode may be protected by an electrolyte-generated oxyfluoride-containing layer, such as cerium oxyfluoride self-formed on the electrochemically active layer as described in U.S. Pat. No. 4,614,569 (Duruz et al.).

DETAILED DESCRIPTION

The invention will be further described in the following Examples:

EXAMPLE 1

A test anode was made by coating by electro-deposition a core structure in the shape of a rod having a diameter of 12 mm consisting of 74 weight % nickel, 17 weight % chromium and 9 weight % iron, such as Inconel®, first with a nickel layer about 200 micron thick and then a copper layer about 100 micron thick.

The coated structure was heat treated at 1000° C. in argon for 5 hours. This heat treatment provides for the interdiffusion of nickel and copper to form an intermediate layer. The structure was then heat treated for 24 hours at 1000° C. in air to form a chromium oxide ($Cr_2O_3$) barrier layer on the core structure and oxidising at least partly the interdiffused nickel-copper layer thereby completing formation of the intermediate layer.

A nickel-ferrite powder was made by drying and calcining at 900° C. the gel product obtained from an inorganic polymer precursor solution consisting of a mixture of molten $Fe(NO_3)_3.9\ H_2O$ with a stoichiometric amount of $Ni(CO_3)_2.6\ H_2O$. A thick paste was made by mixing 1 g of this nickel-ferrite powder with 0.85 g of a nickel aluminate polymer solution containing the equivalent of 0.15 g of nickel oxide. This thick paste was then diluted with 1 ml of water and ground in a pestle and mortar to obtain a suitable viscosity to form a nickel-based paint.

An electrochemically active oxide layer was obtained on the core structure by applying the nickel-based paint onto the core structure with a brush. The painted structure was allowed to dry for 30 minutes before heat treating it at 500° C. for 1 hour to decompose volatile components and to consolidate the oxide coating.

The heat treated coating layer was about 15 micron thick. Further coating layers were applied following the same procedure in order to obtain a 200 micron thick electrochemically active coating covering the intermediate layer and barrier layer on the core structure.

The anode was then tested in a cryolite melt containing approximately 6 weight % alumina at 970° C. by passing a current at a current density of about 0.8 A/cm$^2$. After 100 hours the anode was extracted from the cryolite and showed no significant internal corrosion after microscopic examination of a cross-section of the anode sample.

EXAMPLE 2

A nickel metal core structure was heated in air at 1100° C. for 16 hours to form an oxidised surface layer having a thickness of about 35 micron. The surface layer was black showing the presence of black non-stoichiometric nickel oxide ($NiO_{1+x}$) which is known to act as an oxygen barrier layer and to be electrically conductive.

An interdiffused nickel-copper layer was then applied onto the oxygen barrier and oxidised as described in Example 1.

A mixture of nickel-ferrite and copper-ferrite powder was slurried in an inorganic polymer solution having the required composition for the formation of $CuFe_2O_4$ and $NiFe_2O_4$. The polymer solution had a concentration of 350 g/l oxide equivalent and the powder to polymer ratio was 1 to 0.25. The slurry was used as a coating feed and brushed onto the nickel oxide surface layer of the core structure to form a ferrite-based electrochemically active layer on the nickel oxide layer. After drying the ferrite-based layer at 105° C., the core structure was submitted to a heat treatment at 500° C. in air to consolidate the coating.

Several ferrite-based layers were applied, with each applied layer being heat treated before applying a subsequent layer, to form a consolidated coating of more than 100 micron thick.

EXAMPLE 3

An Inconel® metal core structure as in Example 1 was heated in air at 1000° C. for 10 hours to form an oxidised surface layer of chromium oxide ($Cr_2O_3$) on the core structure acting as a barrier to oxygen.

An interdiffused nickel-copper layer was then applied as described in Example 1.

A nickel ferrite coating feed was prepared by slurrying nickel ferrite powder in an inorganic polymer solution having the required composition for the formation of $NiFe_2O_4$. The powder to polymer ratio was 1 to 0.25. The coating feed was then brushed onto the nickel-copper layer as described in Example 2 and heat treated to form the electrochemically active layer on the intermediate layer.

EXAMPLE 4

A steel core structure was coated with a slurry prepared by suspending chromium oxide ($Cr_2O_3$) in an inorganic $Cr^{3+}$ polymer solution. The feed concentration was greater than 500 g/l of $Cr_2O_3$.

After heat-treating to consolidate the chromium oxide ($Cr_2O_3$) applied layer, thereby forming a barrier layer on the steel structure, a second intermediate layer of interdiffused nickel-copper was applied as described in Example 1 on the barrier layer. Finally the intermediate layer was coated with several electrochemically active layers of $CuFe_2O_4$ and $NiFe_2O_4$ as described in Example 2.

EXAMPLE 5

A test anode was obtained by coating an Inconel® metal core structure with a nickel copper alloy layer and heat-treating it as described in Example 1 to form a barrier layer and an intermediate layer on the metal core structure.

A further layer of a nickel-iron based alloy consisting of 79 weight % nickel, 10 weight % iron and 11 weight % copper of a thickness of approximately 1 mm was then applied on the interdiffused and at least partly oxidised nickel copper layer by plasma spraying.

This alloy layer was then pre-oxidised at 1100° C. for 5 hours for the formation of an electrochemically active oxide layer on the alloy layer. Although preoxidation of the alloy layer is preferred, the treatment is not necessary before using the anode in the cell to produce aluminium.

The test anode was then tested in a cell as described in Example 1. During electrolysis the alloy layer was further oxidised at the alloy layer/active layer interface, self-forming the electrochemically active layer. Simultaneously, the active layer was slowly dissolved into the electrolyte at the active layer/electrolyte interface at substantially the same rate as its rate of formation at the alloy layer/active layer interface, thereby maintaining the thickness of the oxide layer substantially constant, as the alloy layer wears away.

When the alloy layer is worn or damaged, the anode can be reconditioned by clearing at least the worn or damaged parts and reconstituting at least the alloy layer.

EXAMPLE 6

A test anode was obtained by coating an Inconel® metal core structure with a nickel copper layer and heat-treating as described in Example 1 to form a barrier layer and an intermediate layer on the metal structure.

A further layer of a nickel-iron alloy consisting of 30 weight % nickel and 70 weight % iron having a thickness of about 0.5 mm was then applied on the interdiffused nickel copper intermediate layer by plasma spraying.

The nickel-iron alloy layer was then pre-oxidised in air at 1100° C. for 6 hours to form a dense iron oxide-based electrochemically active outer surface layer on the intermediate layer.

The anode was then tested in molten electrolyte containing approximately 6 weight % alumina at 850° C. at a current density of about 0.8 $A/cm^2$. The anode was extracted from the cryolite after 100 hours and showed no sign of significant internal or external corrosion after microscopic examination of a cross-section of the anode sample.

EXAMPLE 7

A test anode was obtained by electrodepositing onto a copper metal core structure a series of successive metallic layers consisting of a nickel layer (10 micron thick) which is known to be well adherent to copper and chromium, a chromium layer (25 micron thick), a nickel layer (50 micron thick) and a copper layer (50 micron thick) and heat treating first in argon and then in oxygen as described in Example 1 to interdiffuse and oxidise the nickel and the copper layers to form an intermediate layer, and oxidise the chromium layer to form an oxygen barrier layer.

An iron layer (200 micron thick) was then electrodeposited onto the interdiffused nickel-copper layer and pre-oxidised at 1100° C. in air for 6 hours to form a dense iron oxide-based electrochemically active outer surface layer on the intermediate layer.

The anode was then tested as in Example 6 and showed no sign of significant internal or external corrosion after microscopic examination of a cross-section of the anode sample.

EXAMPLE 8

A test anode was obtained by coating an Inconel® metal core structure with a nickel copper alloy layer and heat-treating as described in Example 1 to form a barrier layer and an intermediate layer on the metal core structure.

An amount of 1 g of commercially available nickel ferrite powder was slurried with 1 g of an inorganic polymer consisting of a precursor of 0.25 g equivalent nickel-ferrite per 1 ml. An amount corresponding to 5 weight % of $IrO_2$ acting as an electrocatalyst for the rapid conversion of oxygen ions into monoatomic oxygen and subsequently gaseous oxygen was then added to the slurry as $IrCl_4$, as described in concurrently filed application Ser. No. 09/126,114, filed Jul. 30, 1998, still pending The slurry was then brush-coated onto the interdiffused and at least partly oxidised nickel copper alloy layer by applying 3 successive 50 micron thick layers of the slurry, each slurry-applied layer having been allowed to dry by heat-treating the anode at 500° C. for 15 minutes between each layer application.

The anode was then tested in a cell as described in Example 1. During electrolysis the cell voltage was about 120 mV lower than the measured cell voltage of the test described in Example 1.

What is claimed is:

1. A composite, high-temperature resistant, non-carbon, metal-based anode of a cell for the electrowinning of aluminium by the electrolysis of alumina dissolved in a molten fluoride-containing electrolyte, the anode comprising a metal-based core structure of low electrical resistance, for connecting the anode to a positive current supply, coated with a series of superimposed, adherent, electrically conductive layers comprising:

a) at least one layer on the metal-based core structure constituting during electrolysis a barrier substantially impervious to monoatomic oxygen and molecular oxygen;

b) one or more intermediate protective layers on the outermost oxygen barrier layer to protect the oxygen barrier by inhibiting its dissolution, which intermediate layer(s) during electrolysis remain inactive in the reactions for the evolution of oxygen gas; and c) an electrochemically active layer on the outermost intermediate layer, for the oxidation reaction of oxygen ions present at the anode/electrolyte interface into nascent monoatomic oxygen, as well as for subsequent reaction for the formation of gaseous biatomic molecular oxygen;

said active layer being slowly consumable during electrolysis and protecting said intermediate protective layer(s) by inhibiting its/their dissolution into the electrolyte.

2. The anode of claim 1, wherein the core structure comprises a metal, an alloy, an intermetallic compound or a cermet.

3. The anode of claim 2, wherein the core structure comprises at least one metal selected from nickel, copper, cobalt, chromium, molybdenum, tantalum, niobium or iron.

4. The anode of claim 3, wherein the core structure is nickel plated copper.

5. The anode of claim 3, wherein the core structure comprises an alloy consisting of 10 to 30 weight % of chromium, 55 to 90% of at least one of nickel, cobalt or iron, and 0 to 15% of aluminium, titanium, zirconium, yttrium, hafnium or niobium.

6. The anode of claim 3, wherein the core structure comprises an alloy or intermetallic compound containing at least two metals selected from nickel, cobalt, iron and aluminium.

7. The anode of claim 3, wherein the core structure comprises a cermet containing copper-and/or nickel as a metal.

8. The anode of claim 2, wherein the core structure comprises a cermet containing at least one stable oxide selected from the group consisting of nickel cuprate, nickel ferrite, nickel oxide or copper oxide.

9. The anode of claim 1, wherein the oxygen barrier layer comprises chromium oxide.

10. The anode of claim 1, wherein the oxygen barrier layer comprises black non-stoichiometric nickel oxide.

11. The anode of claim 1, wherein the oxygen barrier layer is formed on the core structure by surface oxidation thereof.

12. The anode of claim 1, wherein said intermediate protective layer(s) contains copper, or copper and at least one of nickel and cobalt, and/or oxide(s) thereof.

13. The anode of claim 12, wherein said intermediate layer(s) further comprise(s) iron cuprate, nickel ferrite and/or cobalt ferrite.

14. The anode of claim 12, wherein said intermediate layer(s) comprise an oxidised alloy containing 20 to 60 weight % of copper with one or more further metals forming a solid solution with copper.

15. The anode of claim 14, wherein said further metal is selected from nickel and/or cobalt.

16. The anode of claim 1, wherein the electrochemically active layer comprises oxides which wear away during electrolysis.

17. The anode of claim 16, wherein the electrochemically active layer comprises oxide(s) throughout its thickness.

18. The anode of claim 16, wherein the electrochemically active layer comprises spinels and/or perovskites.

19. The anode of claim 18, wherein the electrochemically active layer comprises ferrites.

20. The anode of claim 19, wherein the electrochemically active layer comprises at least one ferrite selected from the group consisting of cobalt, copper, manganese, magnesium, nickel and zinc ferrite, and mixtures thereof.

21. The anode of claim 20, wherein the ferrite is nickel-ferrite or nickel ferrite partially substituted with $Fe^{2+}$.

22. The anode of claim 19, wherein the ferrite is doped with at least one oxide selected from the group consisting of chromium, titanium, tin and zirconium oxide.

23. The anode of claim 18, wherein the electrochemically active layer has doped, non-stoichiometric and/or partially substituted spinels, the doped spinels comprising dopants selected from the group consisting $Ti^{4+}$, $Zr^{4+}$, $Sn^{4+}$, $Fe^{4+}$, $Hf^{4+}$, $Mn^{4+}$, $Fe^{3+}$, $Ni^{3+}$, $Co^{3+}$, $Mn^{3+}$, $Al^{3+}$, $Cr^{3+}$, $Fe^{2+}$, $Ni^{2+}$, $CO^{2+}$, $Mg^{2+}$, $Mn^{2+}$, $Cu^{2+}$, $Zn^{2+}$and $Li^{+}$.

24. The anode of claim 16, wherein the electrochemically active layer comprises ceramic oxides containing combinations of divalent nickel, cobalt, magnesium, manganese, copper and zinc with divalent/trivalent nickel, cobalt, manganese and/or iron.

25. The anode of claim 1, wherein the electrochemically active layer comprises a metal, alloy, intermetallic compound or cermet which during normal operation in the cell is slowly consumable by oxidation and dissolution into the electrolyte.

26. The anode of claim 25, wherein the active layer is slowly consumable by oxidation and dissolution into the electrolyte with the rate of oxidation being substantially equal to the rate of dissolution.

27. The anode of claim 25, wherein the electrochemically active layer is pre-oxidised prior to electrolysis.

28. The anode of claim 25, wherein the electrochemically active layer comprises iron with at least one metal selected from nickel, copper, cobalt, aluminium and zinc.

29. The anode of claim 28, wherein the electrochemically active layer further comprises at least one additive selected from beryllium, magnesium, yttrium, titanium, zirconium, vanadium, niobium, tantalum, chromium, molybdenum, tungsten, manganese, rhodium, silver, hafnium, lithium, cerium and other Lanthanides.

30. The anode of claim 28, wherein the electrochemically active layer further comprises at least one electrocatalyst selected from iridium, palladium, platinum, rhodium, ruthenium, silicon, tin, mischmetal and metals of the Lanthanide series, and mixture, oxides and compounds thereof.

31. The anode of claim 28, wherein the electrochemically active layer is a surface oxidised iron-nickel layer, the oxidised surface containing iron oxide and/or nickel oxide.

32. The anode of claim 31, wherein the surface of the electrochemically active layer is iron oxide-based.

33. The anode of claim 1, wherein the electrochemically active layer is initially sufficiently thick to constitute an impermeable barrier to gaseous oxygen penetration and at least a partial barrier to nascent and/or mono-atomic oxygen.

34. The anode of claim 1, wherein at least one of said layers is slurry applied.

35. A cell for the production of aluminium by the electrolysis of alumina dissolved in a molten fluoride-containing electrolyte comprising at least one composite anode according to claim 1.

36. The cell of claim 35, wherein the electrolyte is cryolite.

37. The cell of claim 35, comprising at least one aluminium-wettable cathode.

38. The cell of claim 37, comprising at least one drained cathode.

39. The cell of claim 35, which is in a bipolar configuration, and wherein the anodes form the anodic side of at least one bipolar electrode and/or of a terminal anode.

40. The cell of claim 35, comprising means to improve the circulation of the electrolyte between the anodes and facing cathodes and/or means to facilitate dissolution of alumina in the electrolyte.

41. The cell of claim 35, wherein during operation the electrolyte is at a temperature of 700° C. to 970° C.

42. A method of producing aluminium in an aluminium electrowinning cell comprising at least one composite, high-temperature resistant, non-carbon, metal-based anode spaced from a facing cathode, the anode comprising a metal-based core structure of low electrical resistance, for connecting the anode to a positive current supply, coaled with a series of superimposed, adherent, electrically conductive layers, said layers comprising at least one layer on the metal-based core structure constituting during electrolysis a barrier substantially impervious to monoatomic oxygen and molecular oxygen, one or more intermediate protective layers on the outermost oxygen barrier layer to protect the oxygen barrier by inhibiting its dissolution, which intermediate layer(s) during electrolysis remain inactive in the reactions for the evolution of oxygen gas, and an electrochemically active layer on the outermost intermediate layer of a cell for the electrowinning of aluminium by the electrolysis of alumina dissolved in a molten fluoride-containing electrolyte, the method comprising:

a) dissolving alumina in the electrolyte;

b) passing an electrolysis current from the positive current supply through the series of superimposed conductive layers and therefrom to the facing cathode to electrolysed alumina wherein aluminium is produced on the facing cathode and oxygen ions present at the anode/electrolyte interface are oxidized into nascent monoatomic oxygen and gaseous biatomic molecular oxygen is subsequently formed, and c) slowly consuming the active layer which protects said intermediate protective layer(s) by inhibiting its/their dissolution into the electrolyte.

43. The method of claim 42, wherein during electrolysis the or each anode is protected by an electrolyte-generated oxyfluoride-containing layer formed on the electrochemically active layer.

* * * * *